US007032937B2

(12) United States Patent
Boecker et al.

(10) Patent No.: US 7,032,937 B2
(45) Date of Patent: Apr. 25, 2006

(54) LOCK, PARTICULARLY A TAILGATE LOCK FOR A MOTOR VEHICLE

(75) Inventors: Frank Boecker, Hagen (DE); Markus Lauten, Grevenbroich (DE); Joerg Madsen, Moers (DE); Ivica Stanic, Köhn (DE)

(73) Assignee: Intier Automotive Closures, Inc., Newmarket (CA)

( * ) Notice: Subject to any disclaimer, the term of this patent is extended or adjusted under 35 U.S.C. 154(b) by 21 days.

(21) Appl. No.: 10/414,773

(22) Filed: Apr. 16, 2003

(65) Prior Publication Data

US 2004/0056489 A1 Mar. 25, 2004

(51) Int. Cl.
*E05C 3/06* (2006.01)

(52) U.S. Cl. ..... 292/201; 49/280

(58) Field of Classification Search ..... 292/201, 292/216, DIG. 23; 49/279, 280
See application file for complete search history.

(56) References Cited

U.S. PATENT DOCUMENTS 3,690,036 A * 9/1972 Velavicius et al. ..... 49/279
4,691,584 A * 9/1987 Takaishi et al. ..... 74/471 R
4,945,677 A * 8/1990 Kramer ..... 49/210
5,063,710 A * 11/1991 Schap ..... 49/280
6,557,688 B1 * 5/2003 Minasian et al. ..... 192/223

FOREIGN PATENT DOCUMENTS

| | | |
|---|---|---|
| DE | 3817929 A1 | 5/1988 |
| DE | 19714992 A1 | 4/1997 |
| EP | 0 711 891 B1 | 10/1996 |

* cited by examiner

*Primary Examiner*—Gary Estremsky
(74) *Attorney, Agent, or Firm*—Clark Hill PLC

(57) ABSTRACT

A lock, particularly a boot or tailgate lock for a motor vehicle having a drive (14) and a lock mechanism operated by the drive (14), the drive (14) being in the form of an electric motor of reversible construction, wherein the drive (14) acts on a gear wheel (16) operatively connected to at least two clutches (18, 19), while when the drive (14) is actuated in a first driving direction a first clutch (18) couples the drive to first components (20, 22, 24, 30) of the lock mechanism in order to activate at least a first function of the lock mechanism, and when the drive (14) is actuated in a second driving direction a second clutch (19) couples the drive (14) to second components (40, 28, 24) of the lock mechanism in order to activate at least a second function of the lock mechanism.

6 Claims, 6 Drawing Sheets

LOCK, PARTICULARLY A TAILGATE LOCK FOR A MOTOR VEHICLE

FIELD OF THE INVENTION

The present invention relates to a lock, particularly a tailgate lock for a motor vehicle.

BACKGROUND OF THE INVENTION

Vehicle locks are known wherein an electric motor with a step-down or step-up gear drives a lock mechanism by means of which the lock can be secured or released.

A vehicle door lock with a central locking drive and a central locking lever operated thereby is known, for example, from EP 0 711 891 B1. The central locking drive is reversible and of electromechanical construction.

In addition to conventional lock functions such as, for example, mechanical and electric locking, unlocking and mechanical opening and closing, current vehicle locks perform other functions. In the case of tailgate locks for motor cars, in particular, it is desirable to provide electrical closing aids or pulling aids as well as electrical opening aids. At the same time, a lock of this kind should be able to be opened easily by mechanical means, particularly in the event of failure of the on-board electronics.

Conventional locks which perform the functions specified have proved to be relatively large and heavy in construction.

SUMMARY OF THE INVENTION

The problem of the present invention is therefore to improve vehicle locks so that they are smaller and lighter in construction compared with conventional designs and are also cheaper to produce. The invention also sets out to make vehicle locks as quiet as possible.

By means of the measure according to the invention of having an electric motor drive operatively connected to a lock mechanism by means of various clutches, particularly of identical construction, depending on the direction of driving, different functions of the lock mechanism can be achieved in a minimal space simply and inexpensively. In particular, by providing different directions of rotation of the drive in the lock according to the invention, mechanical stops which stop the kinematic processes of the lock mechanism at precisely defined positions can easily be converted in construction.

Appropriately, at least one of the minimum of two clutches is constructed as a freewheeling or roller clutch. This ensures that transmission of torque from the drive of the lock to the lock mechanism will only take place in one direction of driving or rotation of the drive. In particular, it can be used to ensure that a closing operation is separated from an opening operation by transmitting only one of these functions to the lock mechanism while the other function is freewheeling.

According to a preferred embodiment of the lock according to the invention, at least one of the minimum of two clutches is constructed as a centrifugal clutch. By the use of centrifugal clutches, manual operation of the system can be ensured even in the event of a loss of current or failure of the drive. As the clutch is an essential component for realising a "reset" function, there is thus no need to integrate an additional component in the lock to cover the eventuality of loss of power. Another major advantage of a centrifugal clutch is that it only engages and performs the desired function upwards of a certain speed, i.e. at a predetermined power level. As a centrifugal clutch cannot provide any frictional engagement without a power supply, mechanical operation of the lock in the event of a power failure is substantially simpler. The use of centrifugal clutches allows the system to be returned to the original position. At the same time the clutch separates the gear wheel system or lock mechanism from the drive.

If two centrifugal clutches acting in opposite driving directions are provided it will therefore be found that one of the clutches is always freewheeling even while current is being supplied.

According to another preferred embodiment of the lock according to the invention for which special protection is sought, the first driving direction of the drive is used to activate a closing aid and the second driving direction is used to activate an opening aid for the lock.

Expediently, the lock according to the invention has a device for interrupting an electrically activated closing process. Such a function may be used if, for example, a hand, a bag or some other object gets between the boot lid and the vehicle body. This function is conveniently performed by a hook lever which can be raised by pulling a latching lever, thus releasing the interlocking engagement with the lock mechanism or a gear drive.

The lock mechanism appropriately has a multiple step-up, particularly using gear wheels. By the use of gear wheels and/or levers to produce this multiple step-up, the necessary forces for producing a sealing force between a boot lid and the vehicle body can be provided while at the same time minimising the space taken up. The use of gear wheels in particular makes it possible for the force-transmitting components to engage constantly with one another so that, in contrast to conventional constructions with levers as the force transmitters, uniform transmission, i.e. a constant step-up ratio, can be achieved.

BRIEF DESCRIPTION OF THE DRAWINGS

The present invention is now described in more detail with reference to the accompanying drawings, wherein.

DETAILED DESCRIPTION OF THE INVENTION

Figure 1:
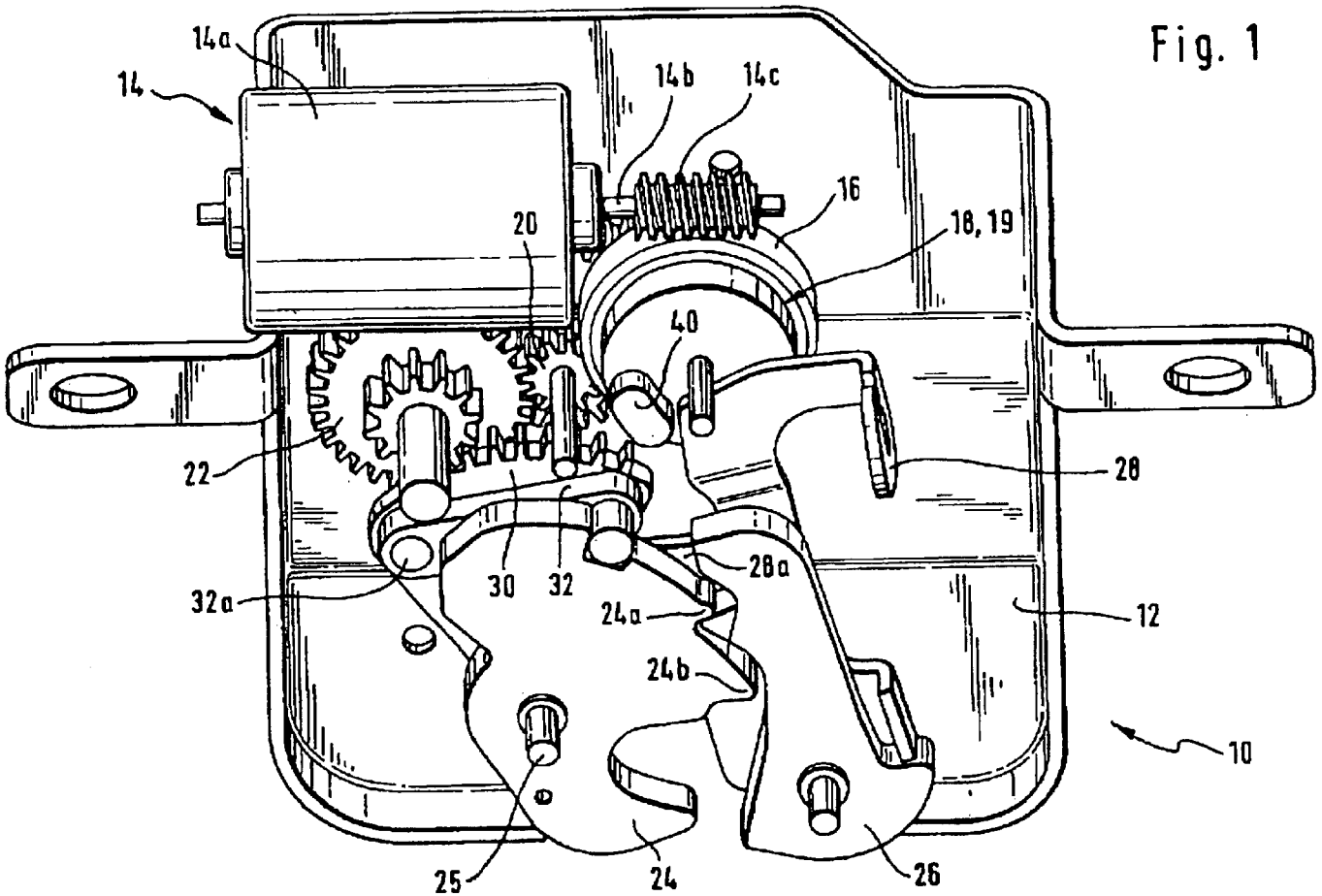
FIG. 1 is a perspective view of a preferred embodiment of a lock according to the invention constructed as a tailgate lock for a motor vehicle.

A preferred embodiment of the lock according to the invention is shown in perspective view in FIG. 1 and generally designated 10. The components of the drive and the lock mechanism are mounted on a baseplate 12.

A drive 14 has a reversing electric motor 14*a* with a motor shaft 14*b* attached thereto which is constructed with a gear 14*c* in the form of a worm gear, for example. The drive 14 is operatively connected to a main gear wheel 16 rotatable about a rotation spindle 16*a* by means of the worm gear 14*c*. The main gear wheel 16 is shown without teeth to simplify the drawing. A double centrifugal clutch 18, 19 is provided on the main gear wheel 16. This centrifugal clutch comprises a first centrifugal clutch 18 (shown in FIG. 2) and a second centrifugal clutch 19 (shown in FIGS. 1 and 4). The first centrifugal clutch 18 serves to perform a closing function and the second centrifugal clutch 19 serves to perform an opening function of the lock shown, as will be explained in more detail hereinafter.

The main gear wheel 16 constitutes the connection of the drive 14 to a lock mechanism. The lock mechanism essentially comprises gear wheels 20,22, a rotary catch 24, a latch 26, a latching lever 28, a gear wheel segment 30, a hook lever 32 and spring elements (not shown).

Figure 3:
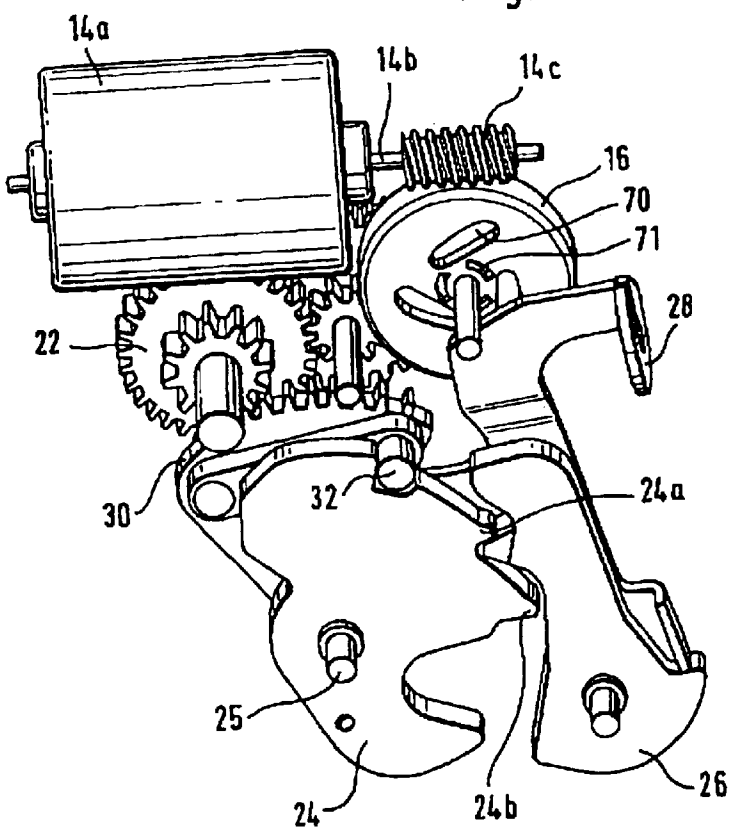
FIG. 3 is another perspective view of the components according to FIG. 2.
Figure 2:
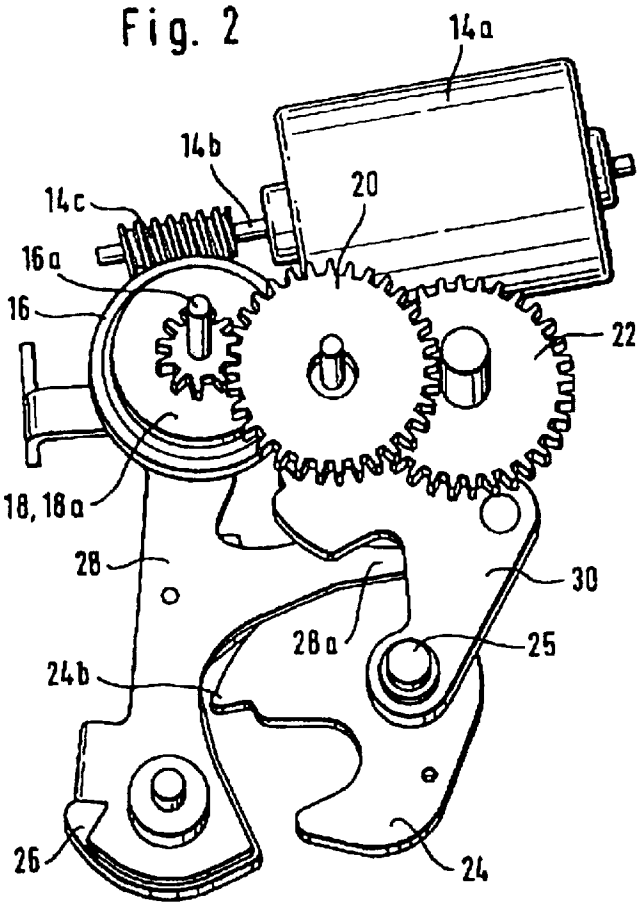
FIG. 2 shows the components of the lock according to FIG. 1 which are essential for the closing function, in perspective view.

First of all, the closing function of the lock shown will be described particularly with reference to FIGS. 2 and 3.

For example, when closing the boot lid of a motor vehicle, first of all an actuating pin (not shown), also known as the cotter or striker, formed on the vehicle body acts on the rotary catch 24. This causes the rotary catch 24 first of all to rotate about its rotation spindle 25 into a preliminary latching position relative to the latch 26, which is defined by a preliminary latching tooth 24*a*. Expediently, in this preliminary latching position, a signal is sent to the drive 14 which causes the drive to rotate in a first direction of rotation. The moment of reaching the preliminary latching position is detected, for example, by means of a microswitch which sends a signal to this effect to a central control unit which in turn sends a control signal to the drive 14. The drive 14 actuates the gear drive 20, 22 via the first centrifugal clutch 18. This actuates the hook lever 32, which is rotatable about a spindle 32*a* on the gear wheel segment 30, as shown in FIG. 1, so that it rotates the rotary catch out of the preliminary latching position into a main latching position or top stroke position which is defined by a main latching lug 24*b*. Once this position is reached the system is blocked. It should be noted that the gear wheel segment 30 is also conveniently constructed to be rotatable about the rotation spindle 25 of the rotary catch 24. Conveniently, the drive 14 is then switched off by means of a switching signal so that the transmission of force in the centrifugal clutch 18 is also cut off. As a result of spring bias provided by springs (not shown) the gear wheel system 20, 22 including the hook lever 32 returns to its original position.

Thus, the cotter or striker is surrounded by the rotary catch 24 or totally hooked to the rotary catch so that the lock is in the fully closed position.

Throughout the entire closing operation the second centrifugal clutch 19 is securely maintained in its freewheeling position.

Figure 5:
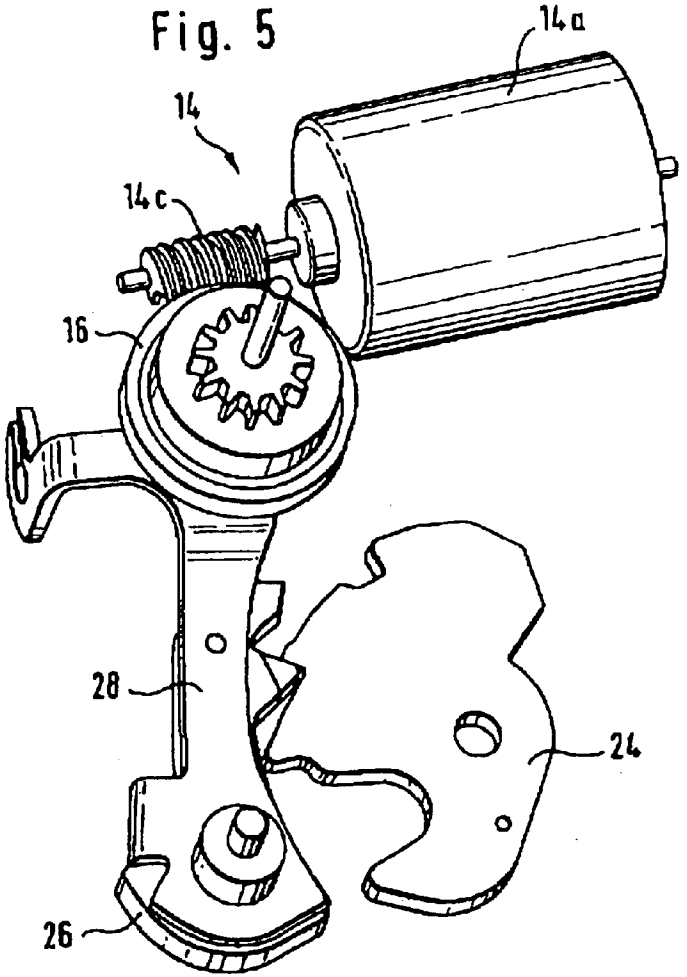
FIG. 5 shows the components according to FIG. 4 in another perspective view.
Figure 4:
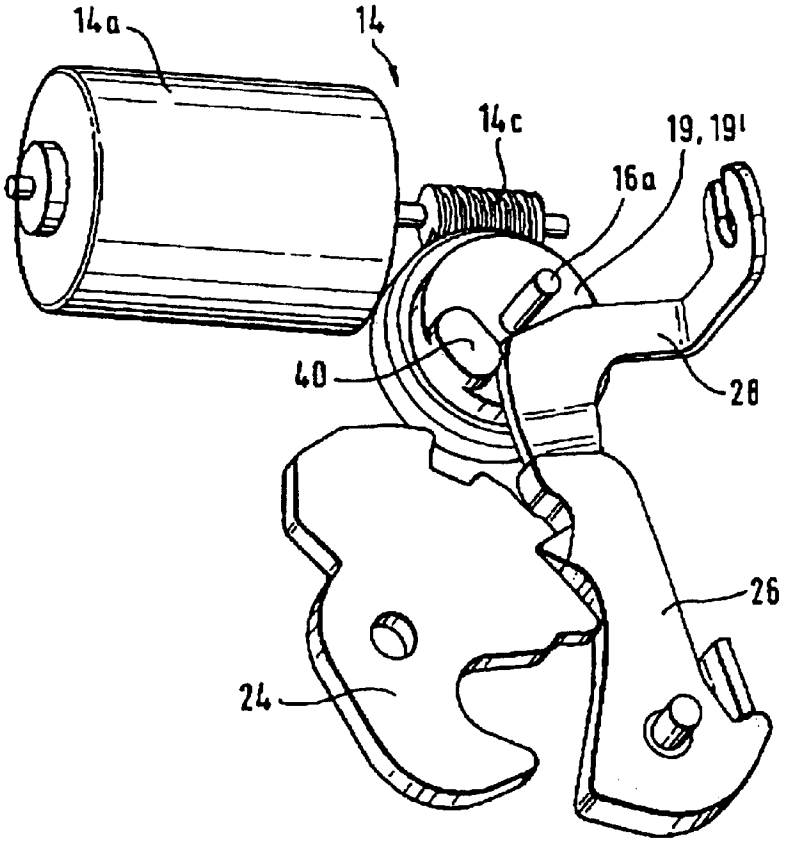
FIG. 4 shows the components of the lock according to FIG. 1 which are essential for an opening or opening assisting function, in perspective view.

The opening function or opening assisting function of the lock shown will now be described in more detail with reference to FIGS. 4 and 5.

Typically, after remote control operation, the drive 14 receives a signal causing the worm gear 14*c* to be driven in its second direction of rotation in order to act on the main gear wheel 16.

The second centrifugal clutch 19, which is mounted on the opposite side of the centrifugal clutch of the main gear wheel 16, has a cam 40, on a coupling element 19*a*, by means of which the latching lever 28 can be operated.

It should be noted that when the main gear wheel 16 is actuated in this second direction of rotation the first centrifugal clutch 18 is in its freewheeling position so that the action on the gear drive 20, 22 described above does not take place.

When the latching lever 28 is actuated by the cam 40 of the second centrifugal clutch 19, this cam raises the hook lever 32 (not shown in FIGS. 4 and 5) out of its latching position. As a result the (spring-loaded) rotary catch 24 is able to open. The movement of the drive cam is blocked by the mechanical stop of the latching lever in the housing. This state is conveniently detected by means of a microswitch so that the drive 14 is switched off by means of a corresponding switching signal, thus cutting off the transmission of force in the second centrifugal clutch 19.

As a result of the spring bias mentioned above the latching lever 28, the latch 26 and the second centrifugal clutch 19 return to their respective original positions.

It should be pointed out here that the interface for converting a manual opening function is formed by the latching lever 28. By actuating a rod or cable operatively connected thereto, the latch and the latching lever mechanically release the rotary catch 24.

Figure 6:
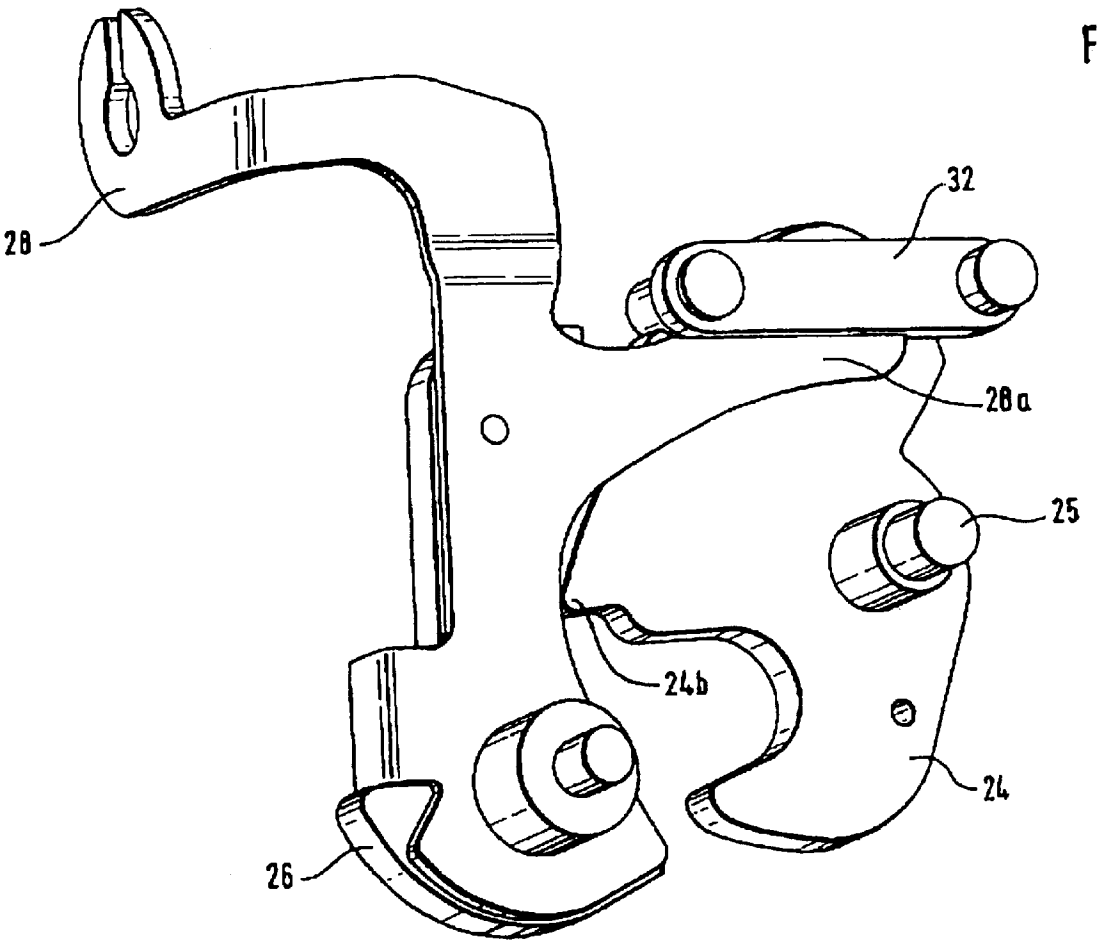
FIG. 6 shows the components according to an alternative embodiment of the lock shown in FIG. 1 which are essential for emergency opening, in a perspective view.

An auxiliary or emergency opening function will now be described by means of an alternative embodiment of the lock according to the invention with reference to FIG. 6. Let us assume, for example, that a hand, a bag or some other object has come between the boot lid and body of a vehicle.

The user then activates the actuating means for mechanical opening, e.g. a door handle, which actuates the latching lever 28. As is clear from FIG. 6, according to this alternative embodiment the latching lever is constructed, for the purpose of carrying out a function, with an additional arm 28*a* which raises the hooking lever 32 on actuation of the latching lever 28 so that the rotary catch 24 can be released. This stops the electric closing operation.

This mechanical auxiliary opening function serves to allow the lock to be opened while the lock is still closing in accordance with its closing function.

The arm 28*a* of the latching lever 28 raises the hooking lever 32 counter to spring bias acting thereon. In principle the hook lever 32 is acting as another latch.

Figure 7:
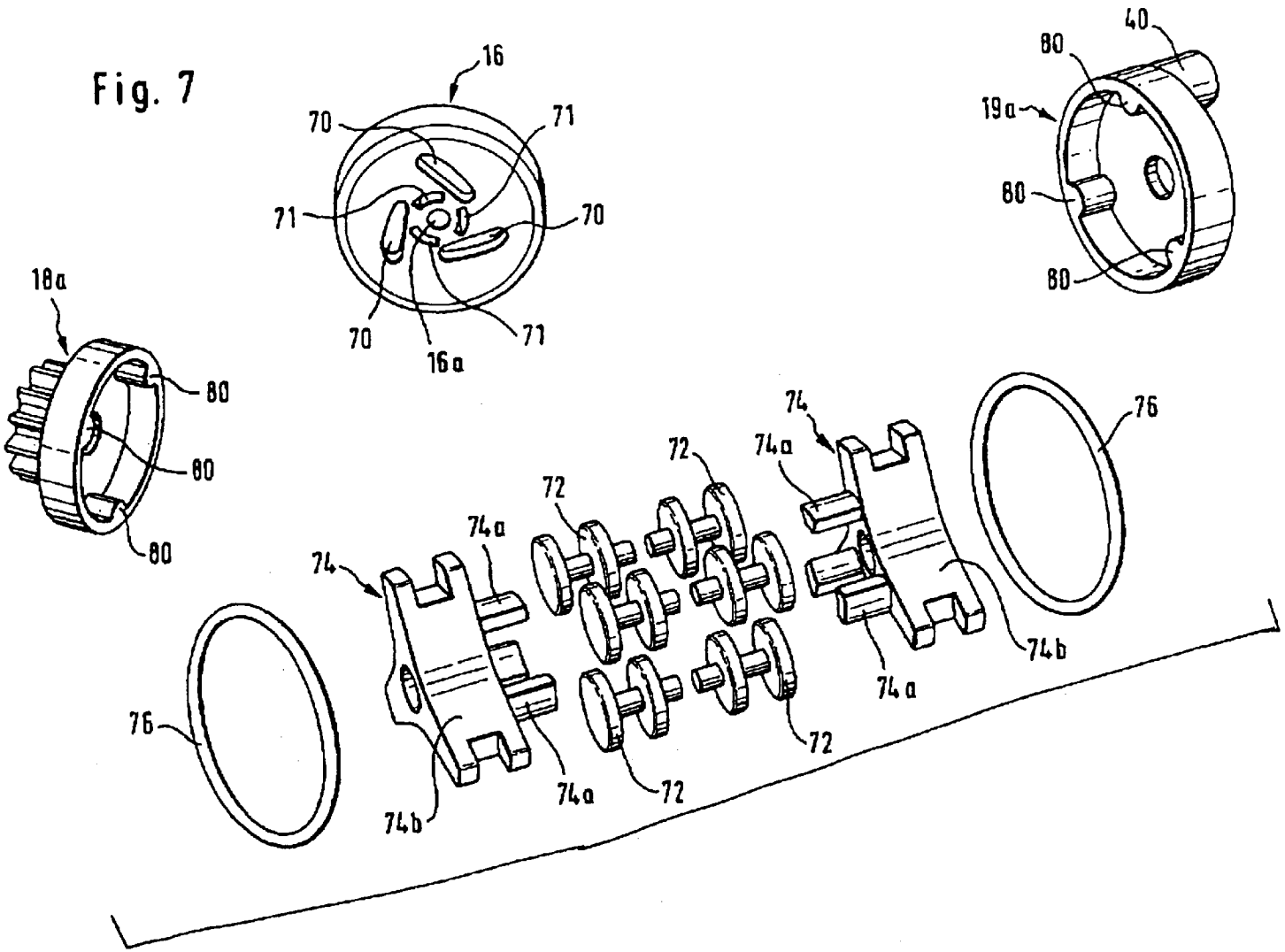
FIG. 7 shows an exploded view of a preferred embodiment of a double centrifugal clutch which may be used in the lock according to the invention.

The double centrifugal clutch which is preferably used in the lock according to the invention will now be described in more detail with reference to FIGS. 7 and 8.

The main gear wheel 16 which is rotatable about the rotation axis 16*a* is constructed with grooves 70 on both sides extending diagonally with respect to the radial direction. FIG. 7 shows only three grooves 70 on one side, because of the perspective view. Three grooves 71 are also formed on both sides of the main gear wheel 16, extending substantially circumferentially of the gear wheel. It should be noted that the second centrifugal clutch has been omitted from FIG. 3 so as to show the grooves formed in the main gear wheel.

A flyweight 72 is mounted to be movable in each of the grooves 70. Transmission pin 74*a* of a transmission element 74 engage, again movably, in the grooves 71.

The transmission elements 74 are substantially star-shaped with three curved interacting surfaces 74*b*, one of the one flyweights 72 being operatively connected to an interacting surface 74*b*. Two coupling springs 76 hold the flyweights on the transmission elements.

The end pieces of the centrifugal clutches 18, 19 shown, which together constitute a double centrifugal clutch, comprise at one end (on the left in FIG. 7) the coupling element 18*a* of the first clutch 18 incorporating a gear wheel, and at the other end the coupling element 19*a* of the second clutch 19 incorporating the cam 40.

Figure 9:
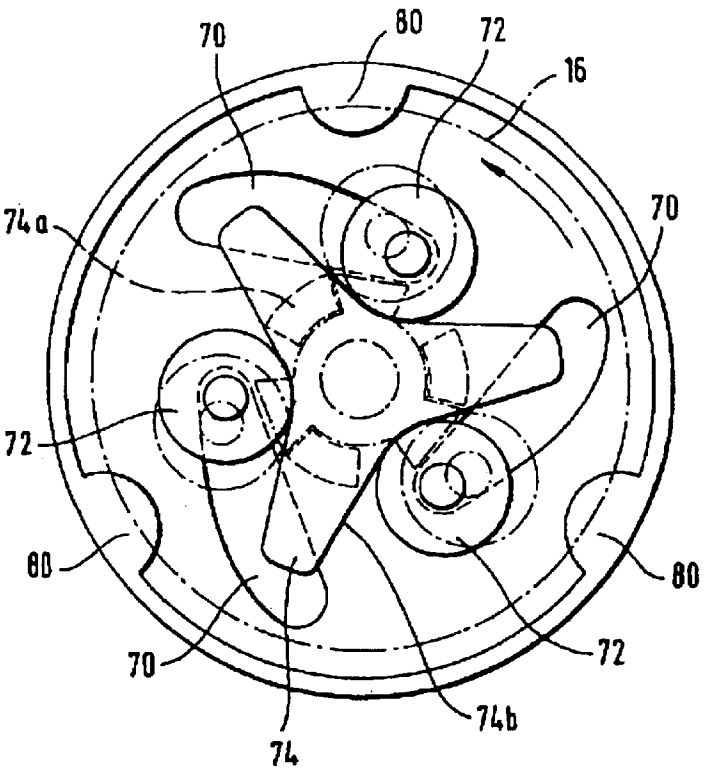
FIG. 9 is a diagrammatic plan view of flywheel weights used within the scope of the centrifugal clutch according to FIG. 7 to produce freewheeling (no force transmission).
Figure 8:
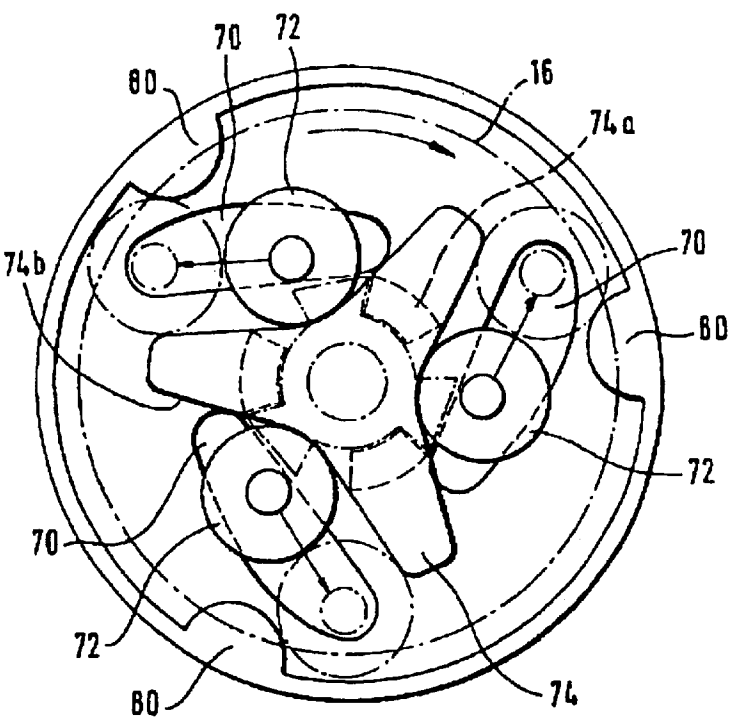
FIG. 8 is a diagrammatic plan view of flywheel weights used within the scope of the centrifugal clutch according to FIG. 7 to produce a coupling action (force transmission)

FIGS. 8 and 9 illustrate how force transmission or freewheeling can be achieved with the individual clutches 18 or 19 of the double centrifugal clutch.

In FIG. 8 it is assumed that the main gear wheel 16 is moving clockwise. This leads to a relative positioning of the transmission element 74 with respect to the grooves 70 in which the points or tips of the transmission element do not project beyond the grooves 70. Thus, the transmission element does not interfere with the travel of the flyweights in the grooves 70. The flyweights 72 are therefore moved by centrifugal force into their radially outer position, which means that force or torque is transmitted from the flyweights 72 onto projections 80 integrally formed with the coupling elements 18*a* or 19*a*. Thus, in the direction of rotation shown in FIG. 8, torque is transmitted from the main gear wheel 16 to the coupling element 18*a* or 19*a*. The radially outer positions of the flyweights 72 are shown by dotted lines.

In FIG. 9 it is assumed that the direction of rotation of the main gear wheel 16 is anticlockwise. This results in relative movement between the transmission element 74 and the main gear wheel 16 or the grooves 70 such that the tips of the transmission element 74 project above the grooves 70, thus preventing movement of the flyweights 72 into their radially outer position. The radially outer position of the flyweights which can be achieved here is again shown by dotted lines. All in all, there is no interaction between the flyweights 72 and the projections 80, which means that there is no transmission of force to the coupling element 18*a* or 19*a*. Thus, in this situation, the clutch is freewheeling.

In conclusion, the advantages of the lock according to the invention may be summarised once more as follows: According to the invention a double freewheeling centrifugal clutch can be produced which is relatively compact and cheap to produce compared with conventional solutions. Mechanical stops can be produced thanks to the fact that the electric motor drive can be reversed or reset. A reversing mechanism can be obtained both after an electric closing operation and after an electric opening operation, by means of the spring biasing of the mechanical components (not shown in detail). Thanks to the transmission of force achieved according to the invention by means of a stepping up operation using a number of gear wheels, sealing forces of up to 1,200 N can easily be achieved. For example, the gear drive according to the embodiment shown provides a four-fold step-up in total. Finally, the lock according to the invention permits mechanically assisted opening as well as opening in the event of a loss of power.

Finally, the design of the lock according to the invention is based on a modular structure. Various embodiments can be created by removing, adding or altering individual components or functional assemblies. In a specific example shown, the latching lever 28 was modified by means of a second arm 28*a*. Embodiments with electrical closing assistance but without electrical opening assistance or exclusively with electrical opening assistance are also possible.

What is claimed is:

1. A lock for a motor vehicle having a drive (14) and a lock mechanism operated by the drive (14), the drive (14) being in the form of an electric motor of reversible construction, characterised in that the drive (14) acts on a gear wheel (16) operatively connected to at least two clutches (18, 19) positioned on opposite sides of the gear wheel, wherein when the drive (14) is actuated in a first driving direction a first clutch (18) couples the drive to first components (20, 22, 24, 30) of the lock mechanism in order to activate an opening function of the lock mechanism, and when the drive (14) is actuated in a second driving direction, opposite the first driving direction, a second clutch (19) couples the drive (14) to second components (40, 28, 24) of the lock mechanism in order to activate a closing function of the lock mechanism.

2. A lock according to claim 1, characterised in that at least one of the two clutches (18, 19) is constructed as a freewheeling or roller clutch.

3. A lock according to claim 2, characterised in that at least one of the two clutches (18, 19) is constructed as a centrifugal clutch.

4. A lock according to claim 3, characterised in that the first driving direction is used to activate a closing aid and the second driving direction is used to activate an opening aid.

5. A lock according to claim 4, characterised by means (28, 28*a*, 32) for stopping an electrically activated closing operation.

6. A lock according to claim 5, characterised in that the lock mechanism comprises a step-up gear, particularly using at least two gear wheels.

* * * * *